US006457389B1

(12) United States Patent
Hu

(10) Patent No.: US 6,457,389 B1
(45) Date of Patent: Oct. 1, 2002

(54) SWITCHING ARRANGEMENT FOR A REVERSIBLE RATCHET TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/923,120

(22) Filed: Aug. 6, 2001

(30) Foreign Application Priority Data

Aug. 22, 2000 (TW) ..... 89214687 U

(51) Int. Cl.[7] ..... B25B 13/46
(52) U.S. Cl. ..... 81/63.2; 81/63; 81/60
(58) Field of Search ..... 81/63.2, 63.1, 81/63, 62, 61, 60

(56) References Cited

U.S. PATENT DOCUMENTS

| | | | | |
|---|---|---|---|---|
| 15,482 A | | 8/1856 | Gilman | |
| 810,599 A | | 1/1906 | Ansorge | |
| 841,686 A | | 1/1907 | Hatfield | |
| 893,097 A | | 7/1908 | Reams | |
| 915,446 A | | 3/1909 | Kearnes | |
| 1,033,358 A | | 7/1912 | Turner | |
| 1,194,471 A | | 8/1916 | Boosinger | |
| 1,261,092 A | | 4/1918 | Allen | |
| 1,382,492 A | | 6/1921 | Evans | |
| 1,426,127 A | | 8/1922 | Tuttle | |
| 1,614,039 A | | 1/1927 | Mandl | |
| 1,957,462 A | * | 5/1934 | Kress | 81/63 |
| 2,317,461 A | | 4/1943 | Jackson | |
| 2,542,241 A | | 2/1951 | Fors | |
| 2,657,604 A | * | 11/1953 | Rueb | 81/63.2 |
| 2,701,977 A | | 2/1955 | Stone | |
| 2,764,048 A | | 9/1956 | Thompson | |
| 2,769,360 A | | 11/1956 | Cottrell et al. | |
| 2,800,821 A | | 7/1957 | Fruscella | |
| 2,891,434 A | | 6/1959 | Lozensky | |
| 2,957,377 A | * | 10/1960 | Hare | 81/63.2 |
| 3,019,682 A | * | 2/1962 | Hare | 81/63.2 |
| 3,250,157 A | | 5/1966 | Badger | |
| 3,265,171 A | * | 8/1966 | Kilness | 81/63 |
| 3,337,014 A | * | 8/1967 | Sandrick | 81/63 |
| 3,393,587 A | | 7/1968 | Jolliff et al. | |
| 3,393,780 A | | 7/1968 | Kilness | |
| 3,436,992 A | | 4/1969 | Over et al. | |
| 3,577,816 A | | 5/1971 | Alexander et al. | |
| 3,713,356 A | | 1/1973 | Knudsen | |
| 3,742,788 A | | 7/1973 | Priest | |
| 3,838,614 A | | 10/1974 | O'Donnell | |
| 3,908,487 A | | 9/1975 | Plaw | |
| 4,070,932 A | | 1/1978 | Jeannotte | |
| 4,111,077 A | | 9/1978 | Cummings et al. | |
| 4,128,025 A | | 12/1978 | Main et al. | |
| 4,274,311 A | | 6/1981 | Ebert | |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—James G. Smith
*Assistant Examiner*—Hadi Shakeri
(74) *Attorney, Agent, or Firm*—Alan Kamrath; Rider, Bennett, Egan & Arundel, LLP

(57) ABSTRACT

A wrench includes a handle and a head extended from the handle. The handle comprises a compartment for rotatably receiving a switch member and a cavity having a first end communicated with the compartment and a second end communicated with a hole of the head. A positioning device cooperates with two positioning grooves in the compartment of the handle for retaining the switch member in one of two positions corresponding to two opposite ratcheting directions of the wrench. A biasing device cooperates with a pawl in the cavity of the handle in response to the position of the switch member to thereby bias the pawl to be selectively engaged with a drive member rotatably received in the hole of the head.

20 Claims, 15 Drawing Sheets

U.S. PATENT DOCUMENTS 4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Diebert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,796,492 A 1/1989 Liou
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A * 12/1991 Fosella ..... 81/58.4
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,499,560 A 3/1996 Aeschliman
5,501,124 A 3/1996 Ashby
5,509,333 A 4/1996 Rion
5,533,427 A * 7/1996 Chow ..... 81/63.2
5,557,994 A 9/1996 Nakayama
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
4,770,072 A 9/1998 Neuhaus
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A * 9/1999 McCann ..... 81/63.2
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A * 12/2000 Chen ..... 81/63.2
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,301,998 B1 10/2001 Hu

* cited by examiner

SWITCHING ARRANGEMENT FOR A REVERSIBLE RATCHET TYPE WRENCH

BACKGROUND OF THE INVENTION

1. Field of the Invention

The present invention relates to a switching arrangement for a reversible ratchet type wrench to provide reliable ratcheting and to allow easy assembly and manufacture.

2. Description of the Related Art

Several factors are considered when designing wrenches and spanners, including improving the torque-bearing capacity, providing as many teeth as possible for the drive member, and providing an easy-to-manufacture structure. Applicant's U.S. Pat. No. 6,282,992 and U.S. Pat. No. 6,282,991, both filed on Apr. 3, 2000, disclose biasing arrangements for a pawl of a reversible ratchet type wrench to provide reliable ratcheting and to lower the manufacture cost. Applicant's U.S. patent application Ser. No. 09/854,795 filed on May 14, 2001 discloses an easy-to-manufacture and easy-to-assemble ratcheting type wrench while Applicant's U.S. patent application Ser. No. 09/888,810 filed on Jun. 25, 2001 discloses an easy-to-operate and easy-to-assemble ratcheting type wrench. Further, Applicant's U.S. patent application Ser. No. 09/900,997 filed on Jul. 9, 2001 discloses a switching arrangement for a reversible ratchet type wrench. All of these proposals are intended to fulfill the market's need upon considering the above-mentioned factors in designing wrenches and spanners. The present invention is intended to provide a different design in this regard.

SUMMARY OF THE INVENTION

In accordance with the present invention, a wrench includes a handle and a head extended from the handle. The handle comprises a compartment extending from a first side of the handle toward a second side of the handle but spaced from the first side of the handle. An inner periphery defining the compartment comprises a first positioning groove and a second positioning groove extending from the first side of the handle toward the second side of the handle but spaced from the second side of the handle. The handle further comprises a cavity having a first end communicated with the compartment and a second end communicated with a hole of the head. A drive member is rotatably mounted in the hole of the head. A pawl is slidably mounted in the cavity of the handle and comprises a toothed first side facing the drive member and a second side facing away from the drive member. A switch member is rotatably mounted in the compartment. A positioning device cooperates with the first positioning groove and the second positioning groove for retaining the switch member in one of two positions corresponding to two opposite ratcheting directions of the wrench. A biasing device cooperates with the pawl in response to the position of the switch member to thereby bias the toothed first side of the pawl to be selectively engaged with the teeth of the drive member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
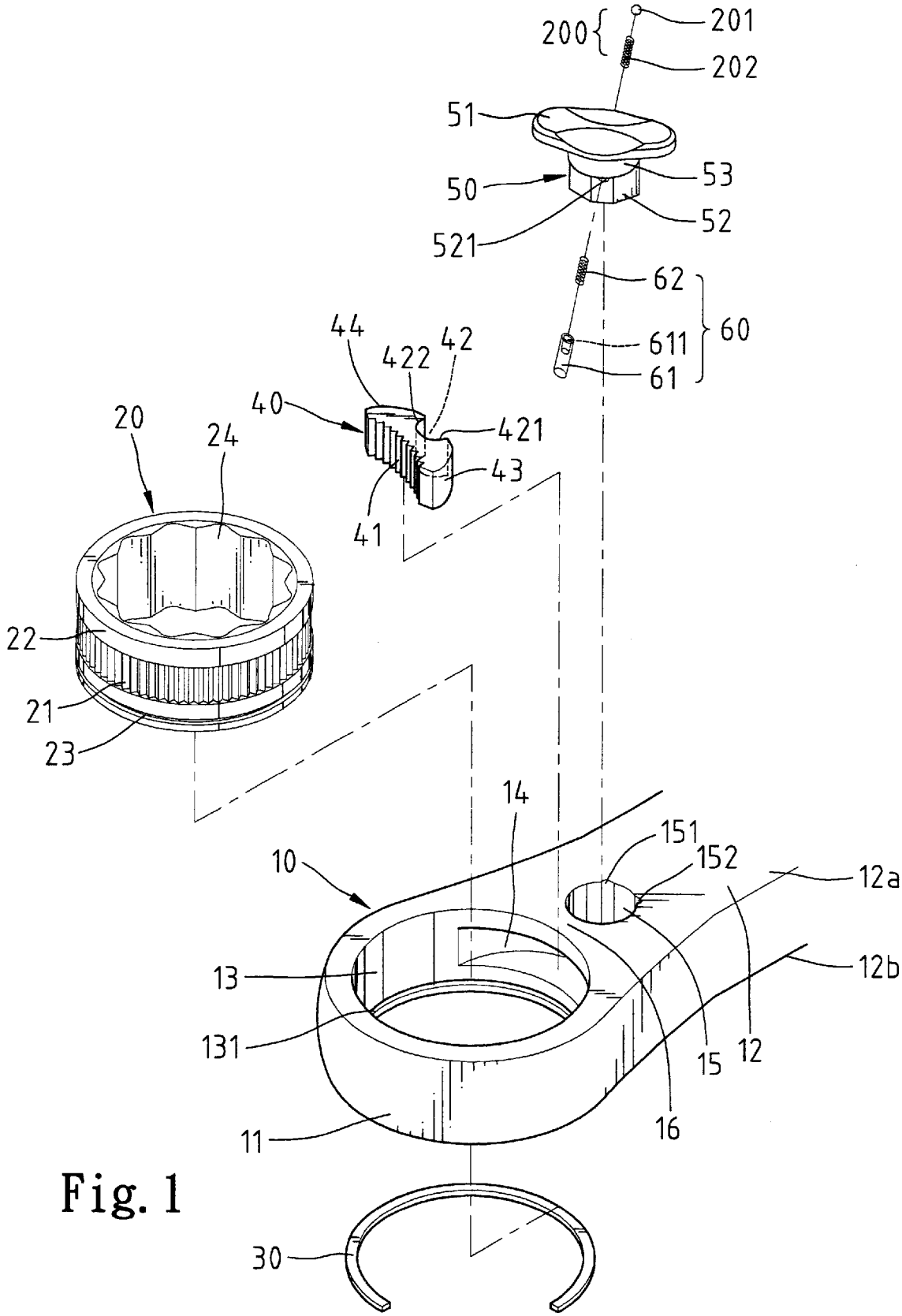
FIG. 1 is an exploded perspective view of an end portion of a first embodiment of a wrench in accordance with the present invention.

Referring to FIGS. 1 through 4, a first embodiment of a ratchet type wrench 10 in accordance with the present invention generally includes a handle 12 and a head 11 extending from the handle 12 and having a hole 13. An inner periphery defining the hole 13 of the head 11 includes an annular groove 131 in a lower portion thereof. A cavity 14 is defined in the handle 12. A compartment 15 is defined in the handle 12 and extends from a first side 12*a* of the handle 12 toward a second side 12*b* of the handle 12 but spaced from the second side 12*b* of the handle 12. The cavity 14 has a first end communicated with the compartment 15 and a second end communicated with the hole 13 of the head 11. Thus, a bridge 16 is defined on the first side 12*a* of the handle 12 for connecting with the head 11. The bridge 16 increases the strength of the head 11 and the handle 12, thereby providing a higher torque-bearing capacity. An inner periphery defining the compartment 15 comprises a first positioning groove 151 and a second positioning groove 152. The two positioning grooves 151 and 152 are machined by means of milling from the first side 12*a* of the handle 12 toward the second side 12*b* of the handle 12 but not through the second side 12*b* of the handle 12. Thus, the positioning grooves 151 and 152 can be easily machined without difficulty.

A drive member (in the form of a gear wheel 20 in this embodiment) is mounted in the hole 13 of the head 11 and includes an inner periphery 24 for driving a fastener (not shown) and an outer periphery 25. The outer periphery 25 includes an upper end portion 22, a lower end portion having an annular groove 23, and a middle portion with a plurality of recessed teeth 21. A C-clip 30 is engaged in the annular groove 23 of the gear wheel 20 and in the annular groove 131 of the head 11, thereby rotatably retaining the gear wheel 20 in the head 11 of the wrench 10, best shown in FIG. 2.

A pawl 40 is mounted in cavity 14 and includes ratchet teeth 41 on a side thereof for engaging with teeth 21 of the gear wheel 20. The other side of the pawl 40 facing away from the gear wheel 20 comprises a groove 42 having a first end 421 and a second end 422, which will be described later. The pawl 40 further comprises a first side 43 and a second side 44.

Figure 2:
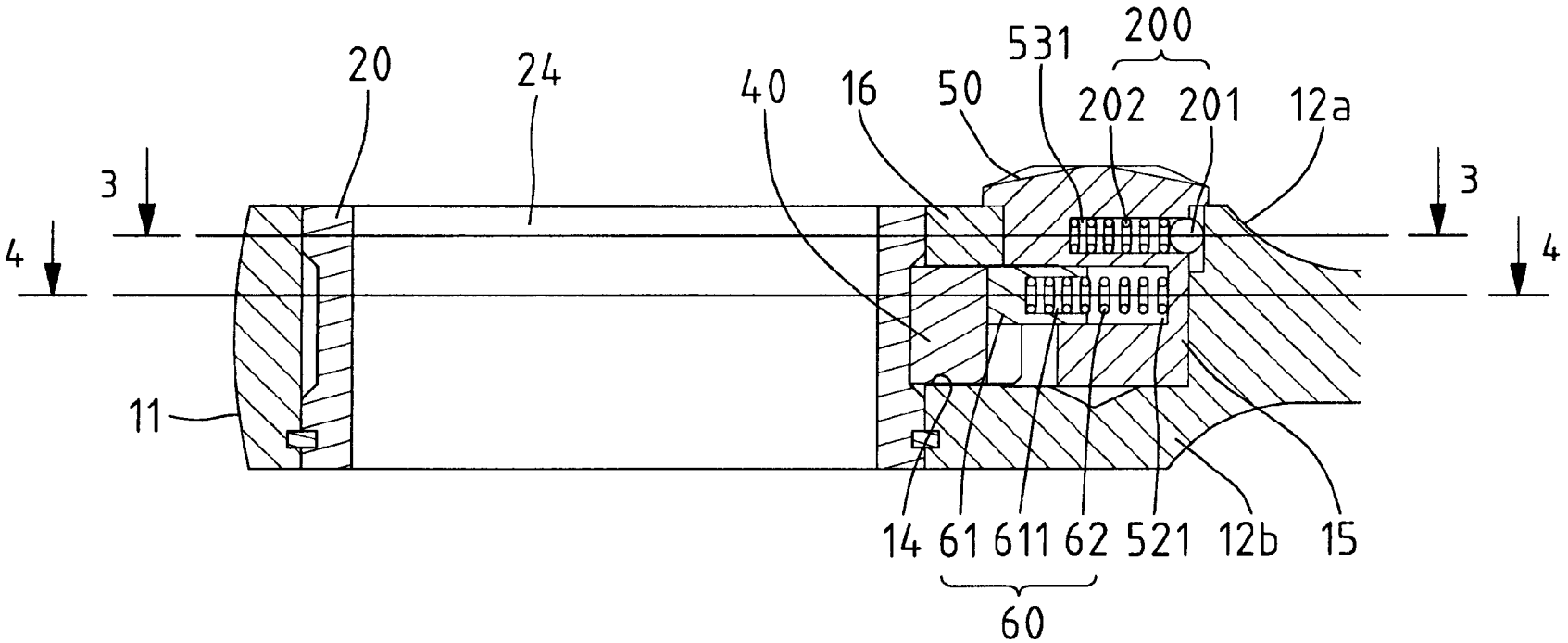
FIG. 2 is a sectional view, taken along line 2—2 in FIG. 3, of the wrench in FIG. 1.
Figure 3:
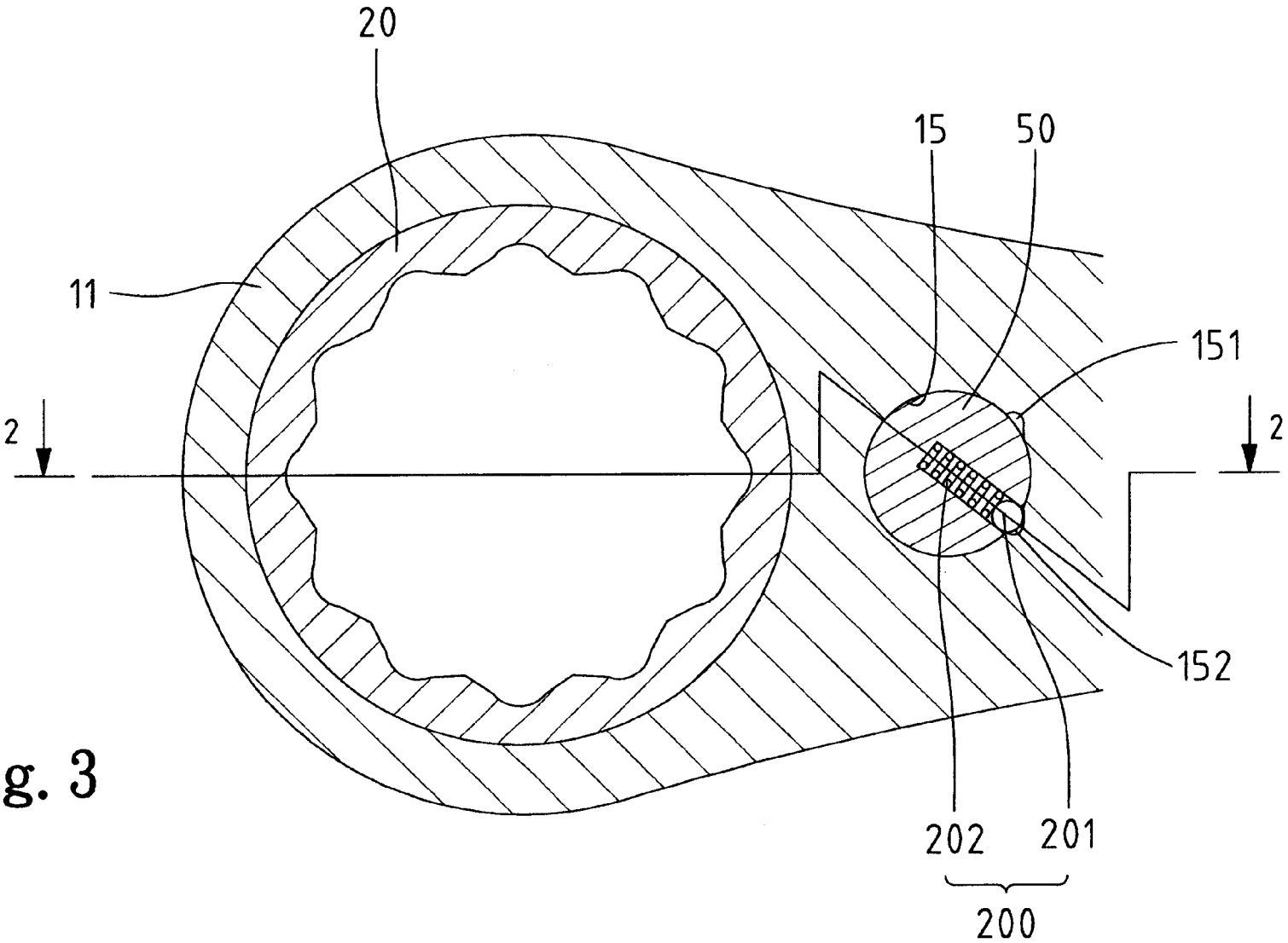
FIG. 3 is a sectional view taken along line 3—3 in FIG. 2.

Still referring to FIGS. 1 through 3, a switch member 50 is rotatably mounted in the compartment 15. In this embodiment, the switch member 50 includes a turn-piece 51 on a top thereof, the turn-piece 51 being preferably located outside the compartment 15 for manual operation. The switch member 50 comprises an actuating portion 52 that is rotatably received in the compartment 15.

Figure 4:
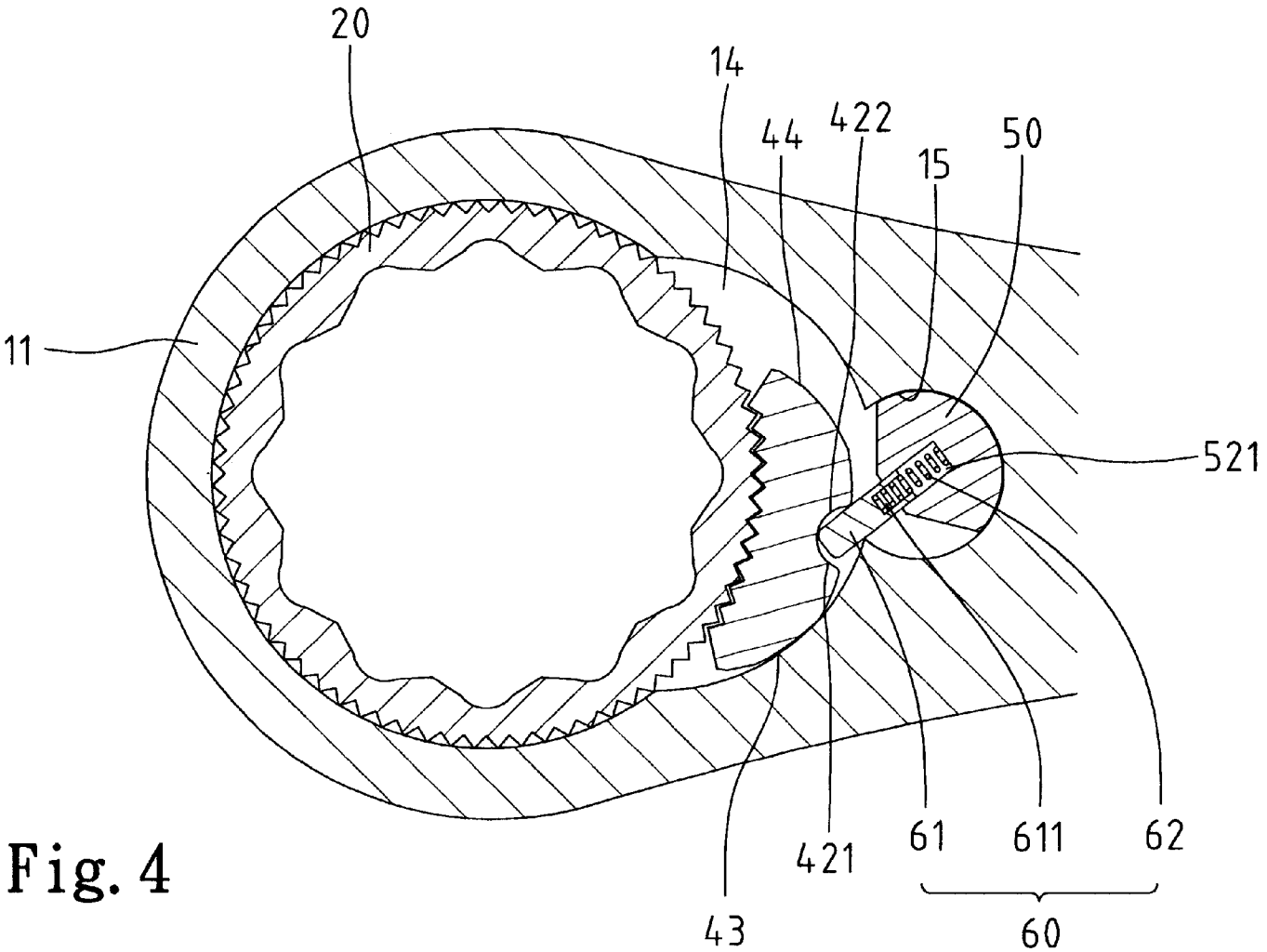
FIG. 4 is a sectional view taken along line 4—4 in FIG. 2.
Figure 5:
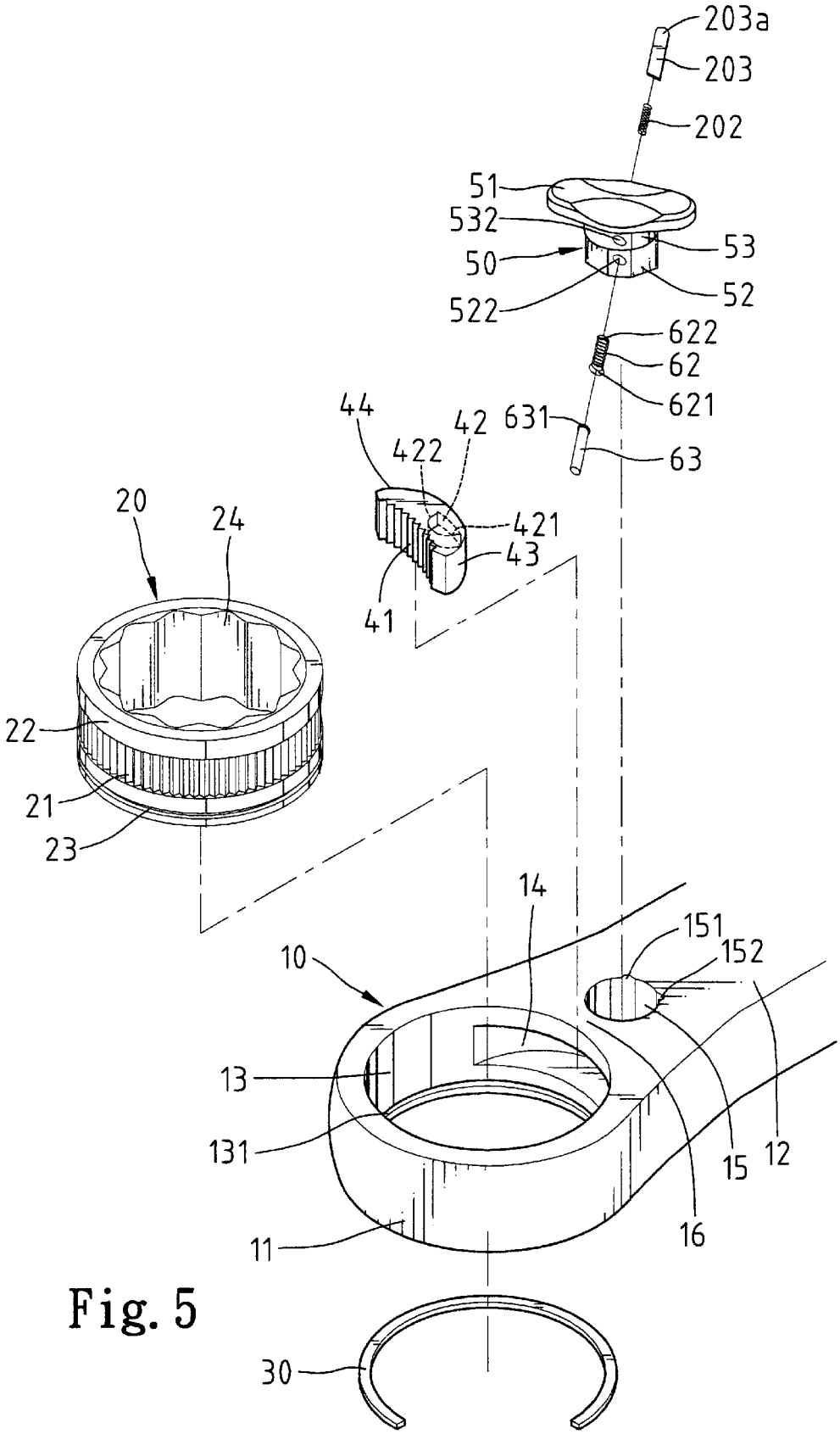
FIG. 5 is a sectional view illustrating a second embodiment of the wrench in accordance with the present invention.

A biasing means 60 is provided to bias the pawl 40 toward the gear wheel 20. In this embodiment, the biasing means 60 comprises a pin 61 and an elastic element 62. The pin 61 comprises a first end received in the groove 42 of the pawl 40 and a second end having a receptacle 611. As illustrated in FIGS. 2 and 4, the elastic element 62 has a first end attached to an end wall defining the receptacle 611 of the pin 61 and a second end attached to an end wall defining another receptacle 521 in the actuating portion 52. It is noted that the second end of the pin 61 is slidably received in the receptacle 521 of the actuating portion 52.

A positioning means 200 is provided to retain the switch member 50 in one of two positions corresponding to two opposite ratcheting directions of the wrench 10. In this embodiment, the positioning means 200 comprises a ball 201 and an elastic element 202 that is received in another receptacle 531 on a rotating portion 53 of the actuating portion 52. The rotating portion 53 is rotatably held by the inner periphery defining the compartment 15. An end of the elastic element 202 is attached to an end wall defining the receptacle 531. The ball 201 is biased by the other end of the elastic element 202 to be selectively engaged with one of the first positioning groove 151 and the second positioning groove 152, as shown in FIGS. 2 and 3.

The ratchet type wrench in FIG. 4 is in a status allowing clockwise ratcheting (free rotation in counterclockwise direction), in which the first end of the pin 61 is biased by the elastic element 62 to press against the first end 421 of the groove 42 of the pawl 40. The first side 43 of the pawl 40 presses against a wall portion defining the cavity 14 of the handle 12. As illustrated in FIG. 3, the ball 201 is partially engaged in the second positioning groove 152 to prevent rotation of the switch member 50. The user may switch the turn-piece 51 of the switch member 50, which causes the ball 201 to slide out of the second positioning groove 152 and then move toward the first positioning groove 151. When the ball 201 enters and is thus positioned in the first positioning groove 151, the pin 61 (FIG. 4) engages with the second end 422 of the groove 42 of the pawl 40. The wrench is then in a status allowing counter-clockwise ratcheting (free rotation in clockwise direction) in which the second side 44 of the pawl 40 presses against another wall portion defining the cavity 14 of the handle 12.

Figure 6:
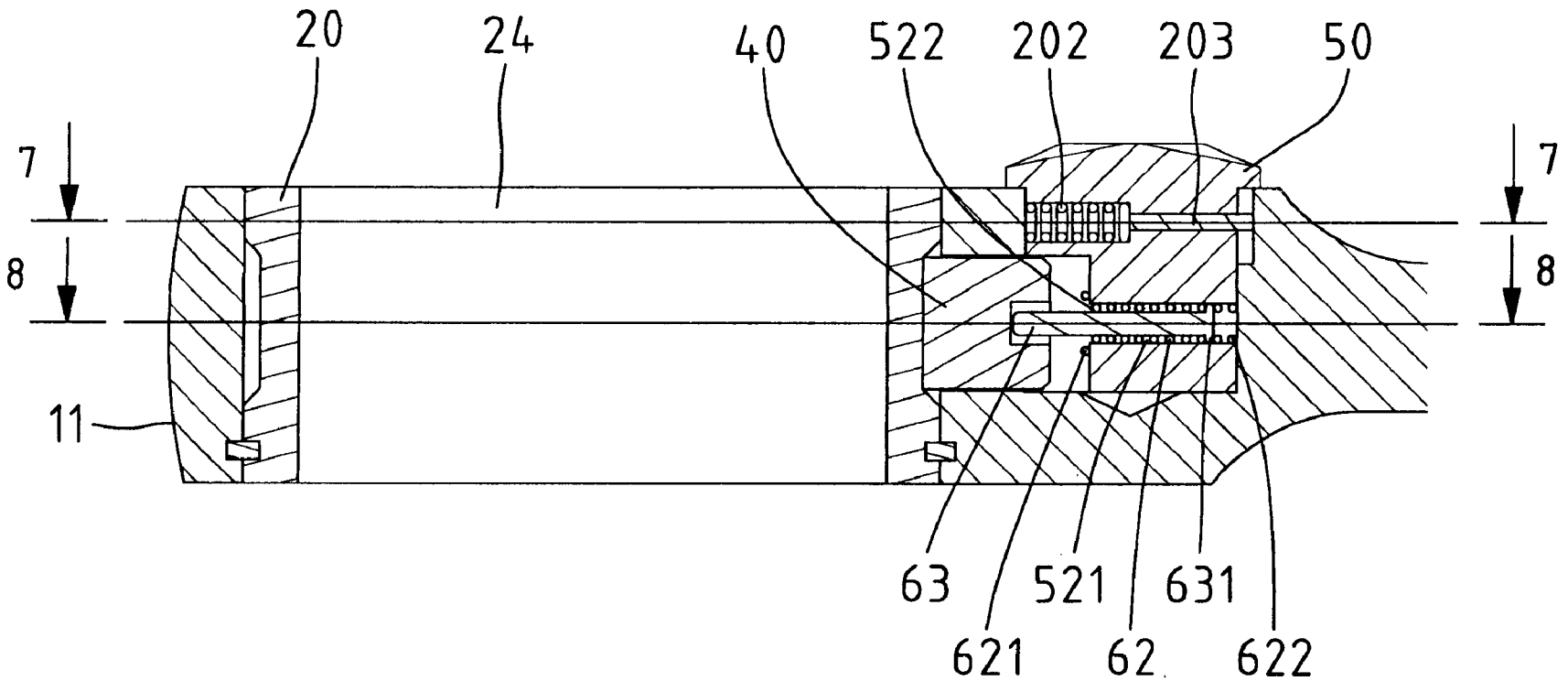
FIG. 6 is a sectional view, taken along line 6—6 in FIG. 7, of the wrench in FIG. 5.
Figure 7:
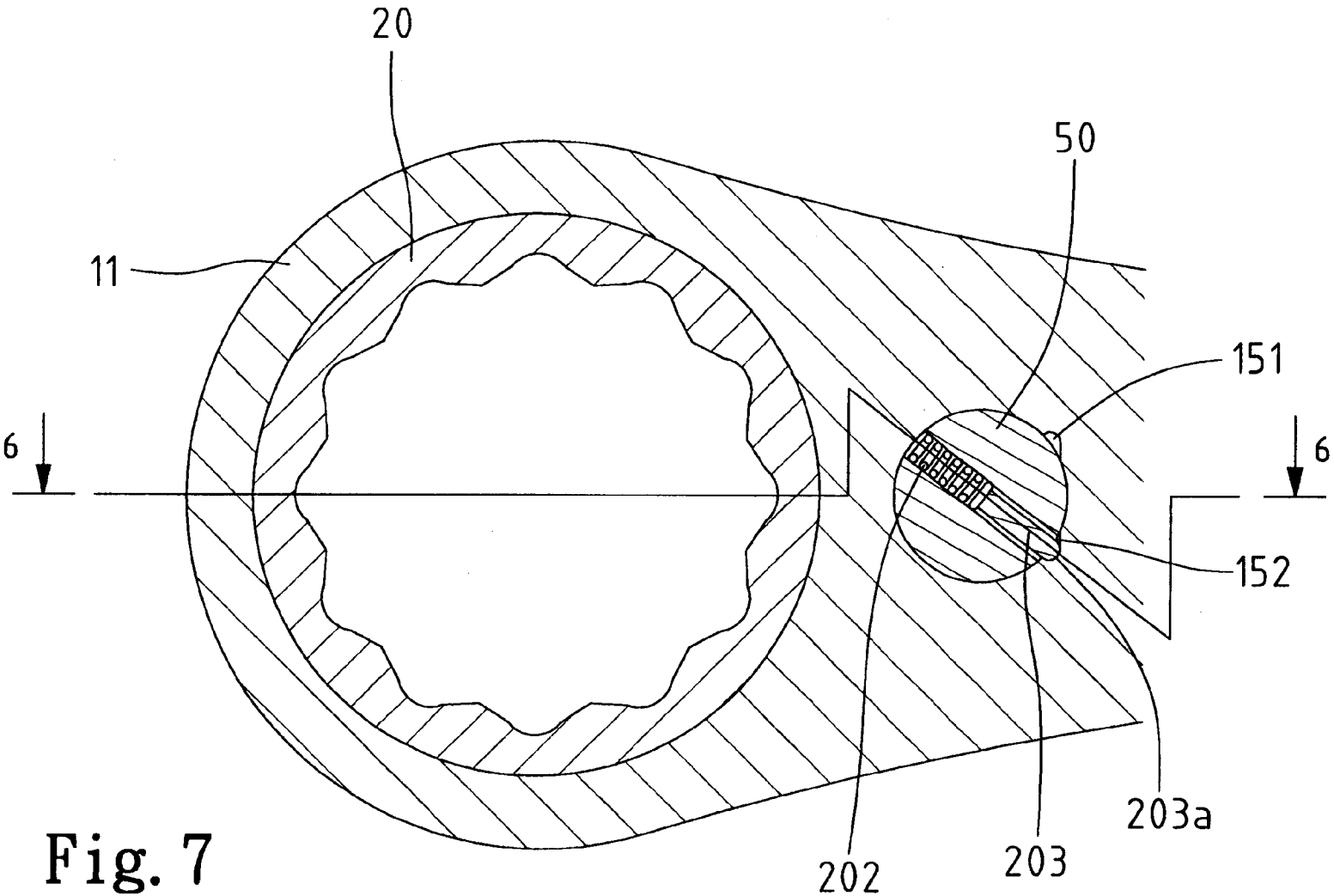
FIG. 7 is a sectional view taken along line 7—7 in FIG. 6.
Figure 8:
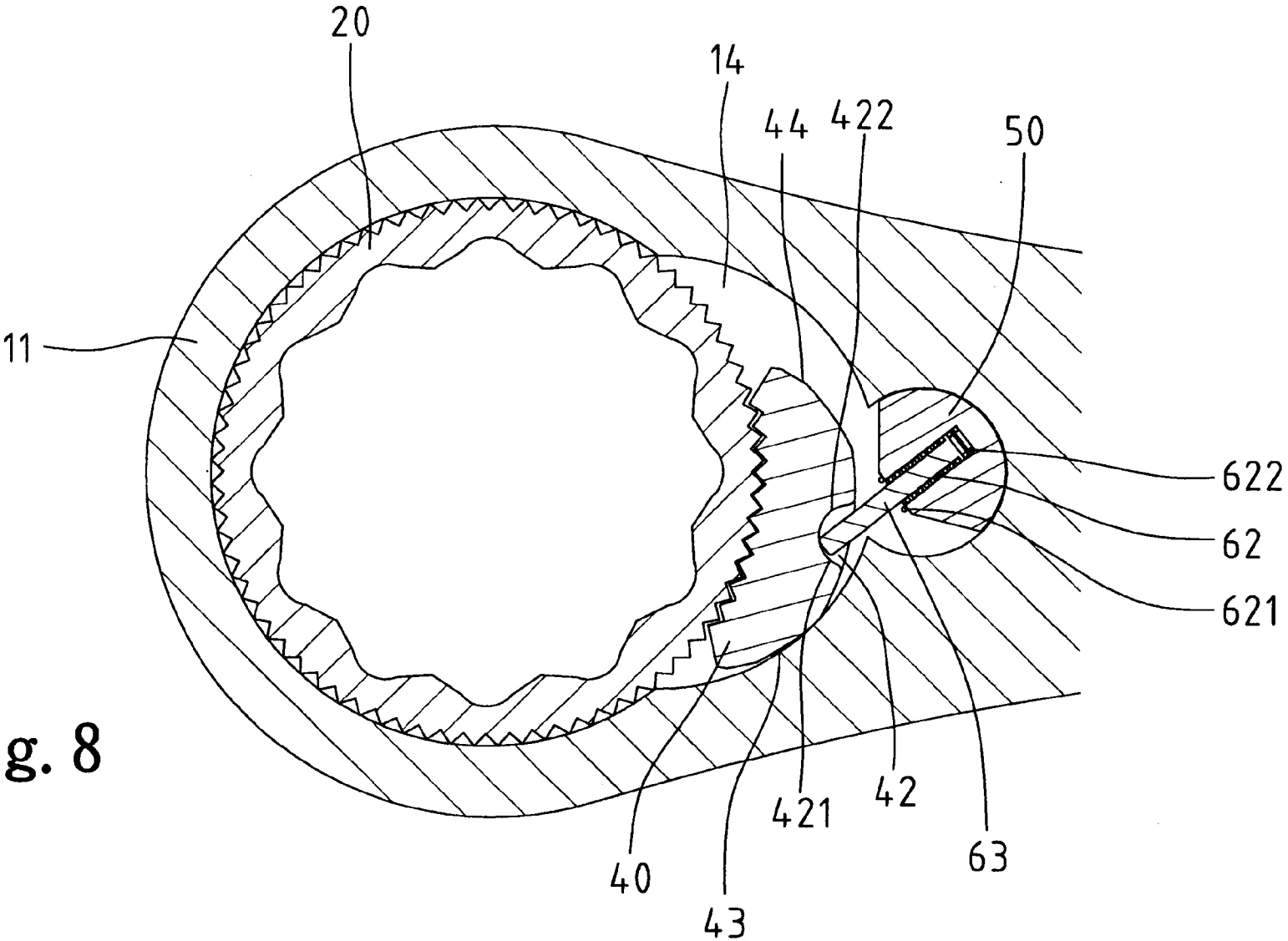
FIG. 8 is a sectional view taken along line 8—8 in FIG. 6.

FIGS. 5 through 8 illustrate a second embodiment of the wrench in accordance with the present invention. In this embodiment, the biasing means comprises a pin 63 and an elastic element 62. The pin 63 comprises a first end received in the groove 42 of the pawl 40 and a second end having a flange 631. As illustrated in FIG. 6, the elastic element 62 has a first end 621 retained in a wall portion surrounding an opening 522 (FIGS. 5 and 6) of a receptacle 521 in the actuating portion 52 and a second end 622 in the receptacle 521. It is noted that the second end of the pin 63 is engaged with the second end 622 of the elastic element 62, best shown in FIG. 6.

The actuating portion 52 comprises a transverse through-hole 532 (preferably extending through the rotating portion 53) having a first section and a second reduced section. In this embodiment, the positioning means comprises a pin 203 and an elastic element 202. The pin 203 is flat and has a dome 203*a* on an end thereof. The elastic element 202 is received in the first section of the transverse through-hole 532 and has a first end attached to the inner periphery defining the compartment 15 and a second end attached to the other end of the pin 203, thereby biasing the dome 203*a* of the pin 203 into one of the positioning grooves 151 and 152.

Figure 9:
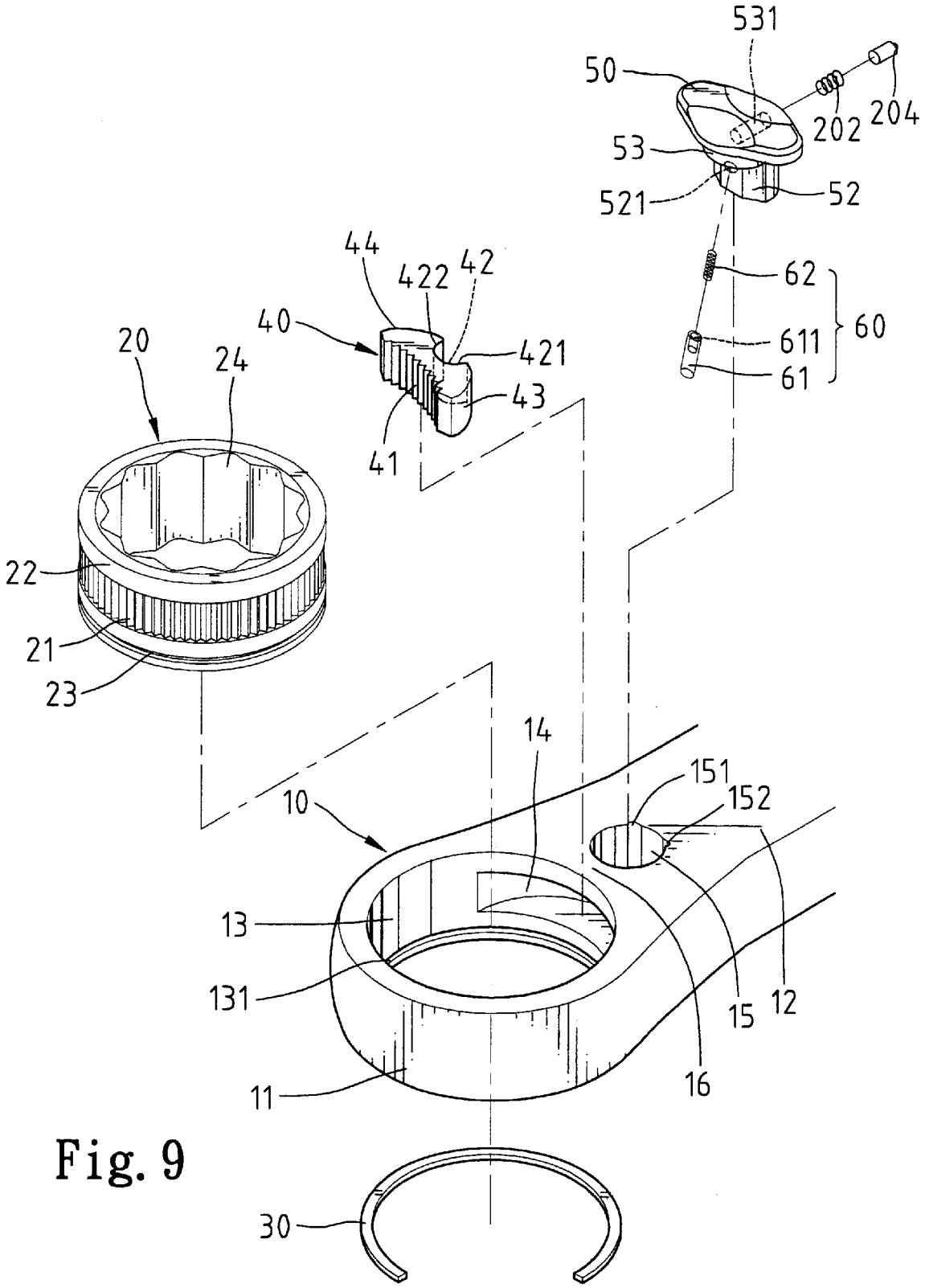
FIG. 9 is an exploded perspective view illustrating a third embodiment of the wrench in accordance with the present invention.
Figure 10:
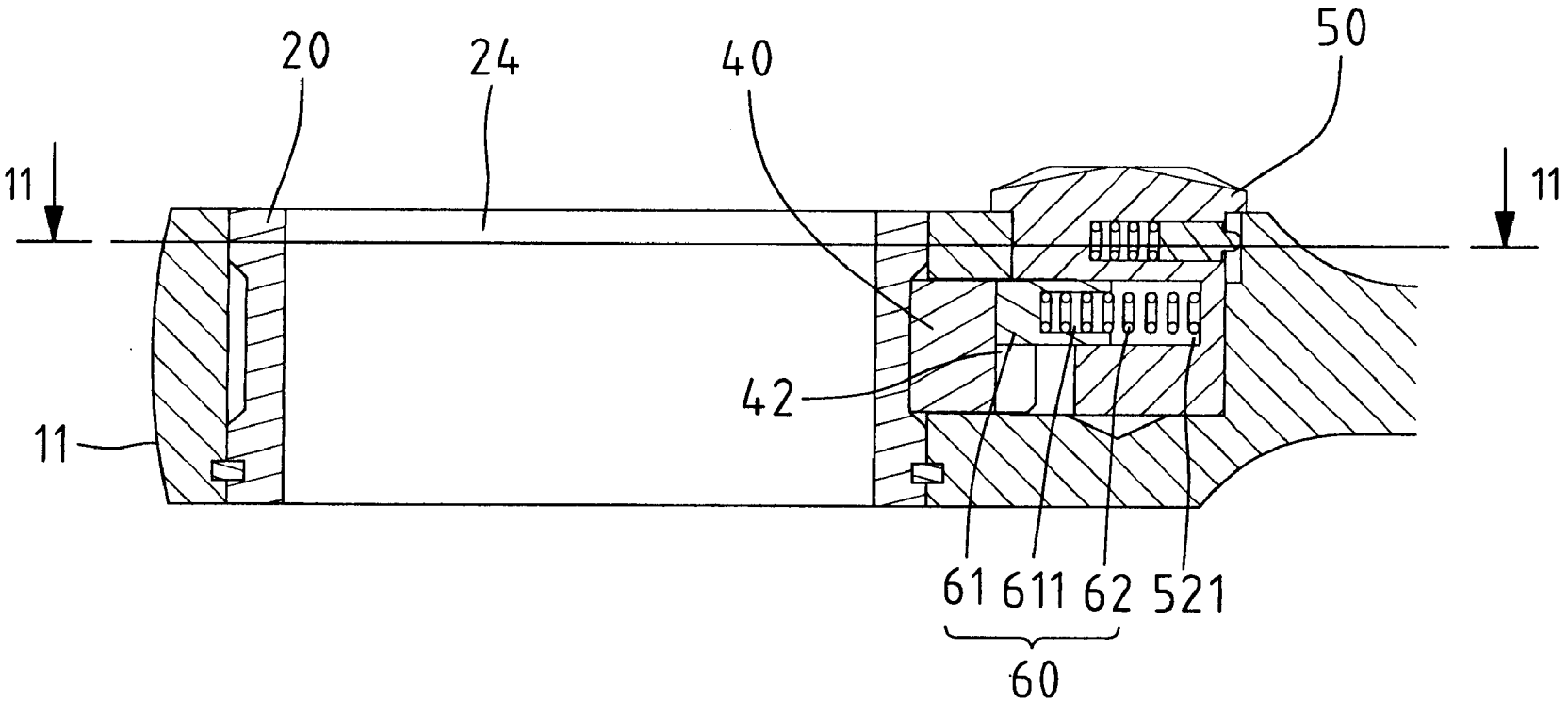
FIG. 10 is a sectional view, taken along line 10—10 in FIG. 11, of the wrench in FIG. 9.
Figure 11:
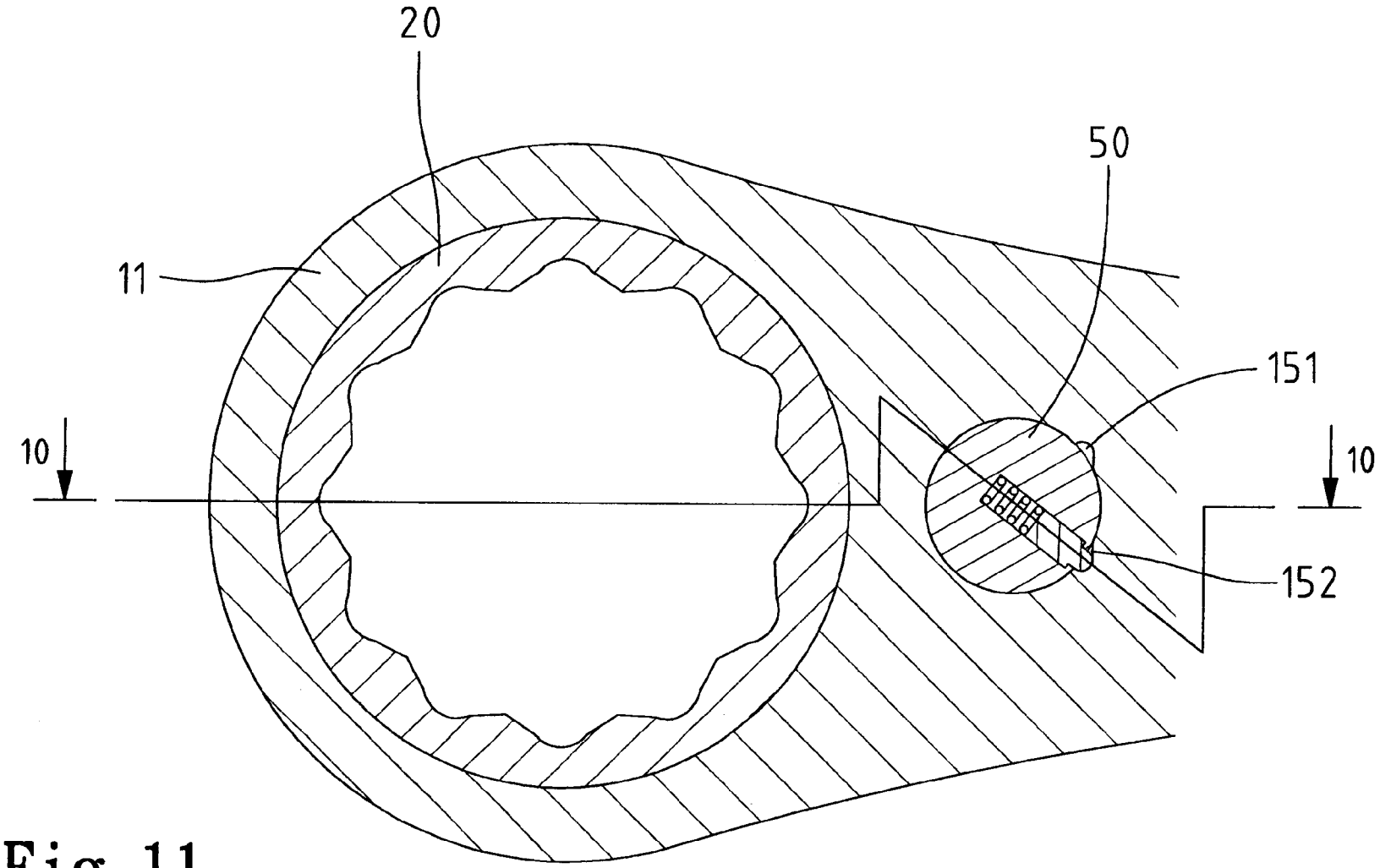
FIG. 11 is a sectional view taken along line 11—11 in FIG. 10.
Figure 12:
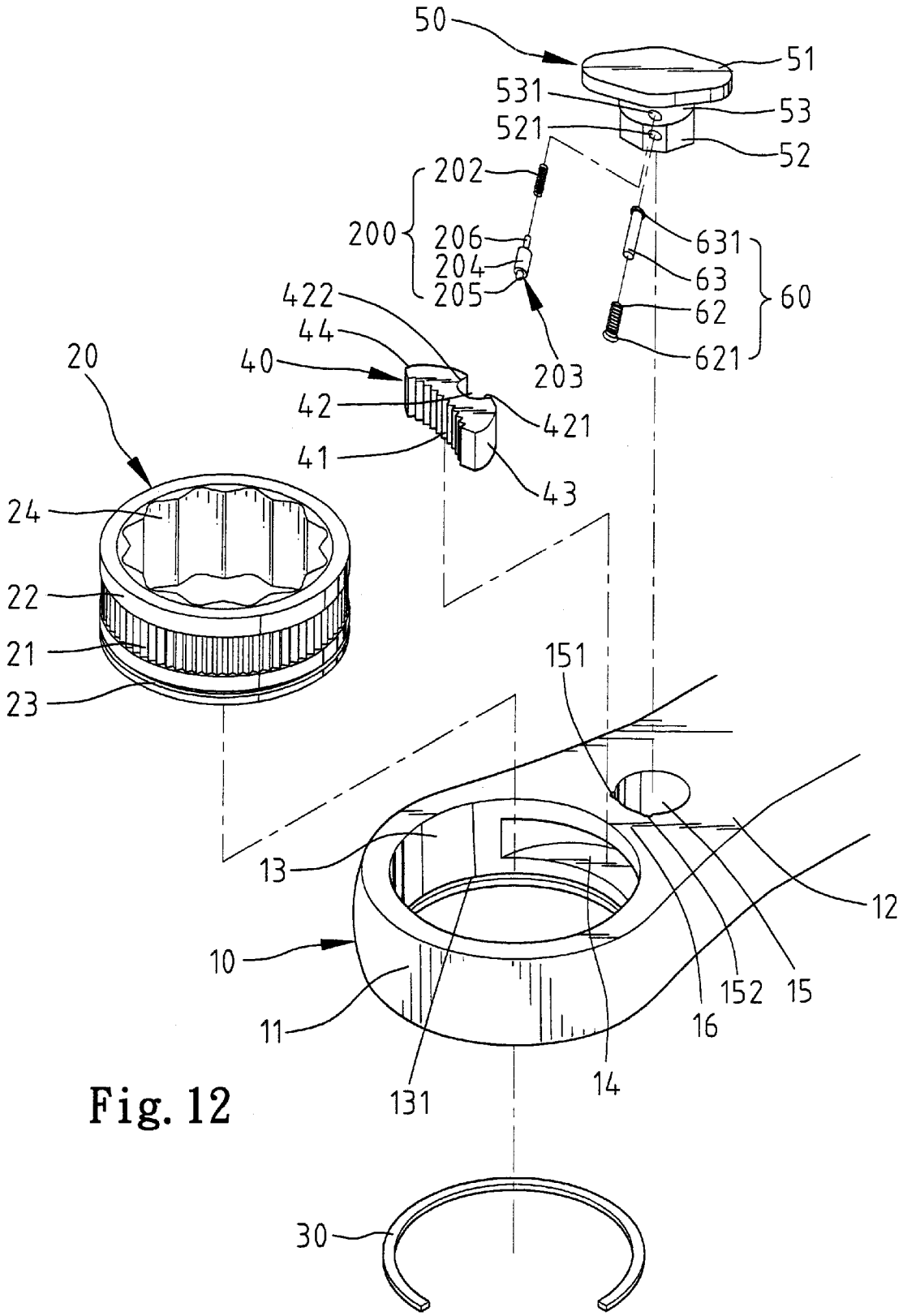
FIG. 12 is a sectional view illustrating a fourth embodiment of the wrench in accordance with the present invention.
Figure 13:
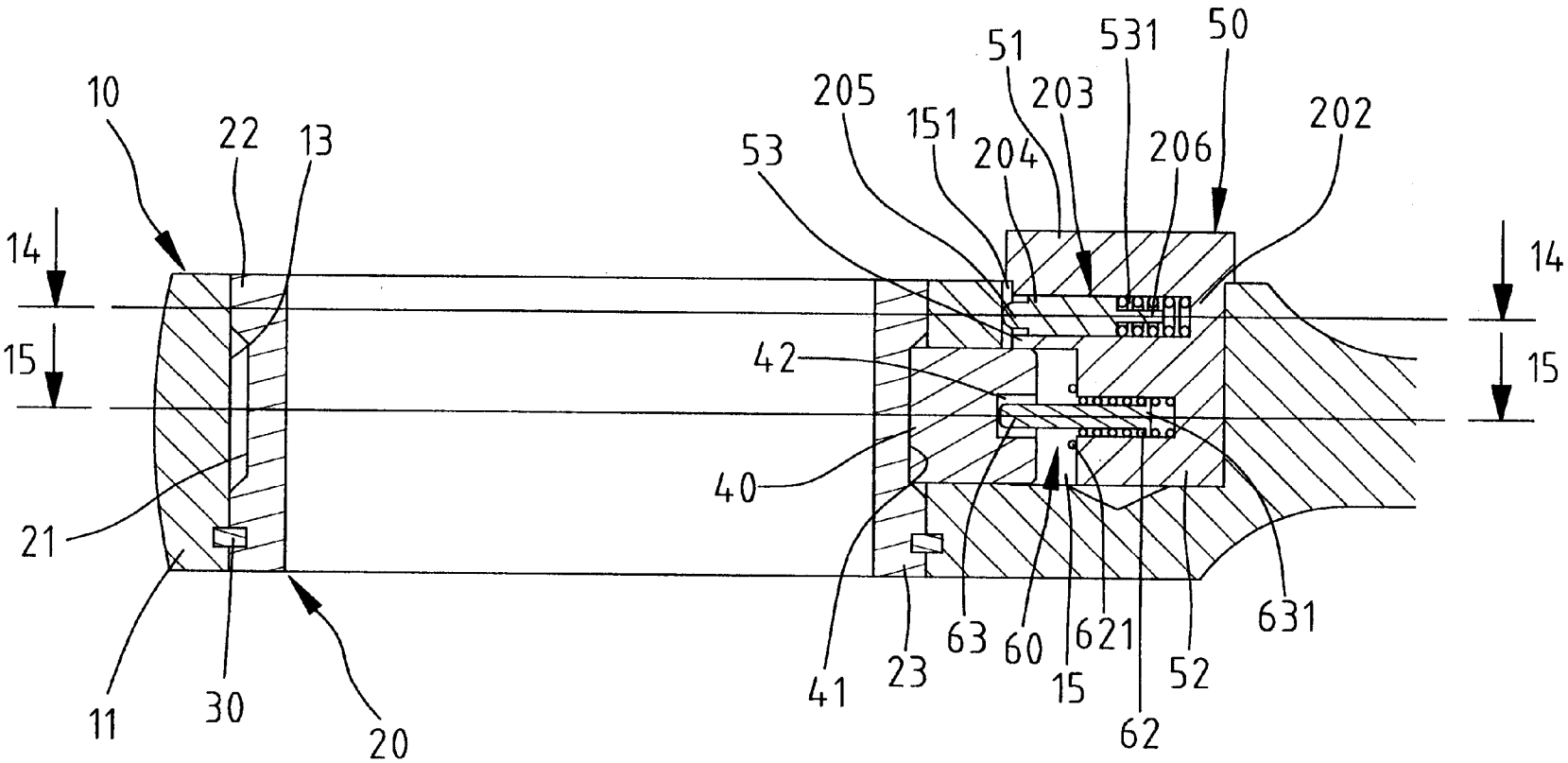
FIG. 13 is a sectional view, taken along line 13—13 in FIG. 14, of the wrench in FIG. 12.
Figure 14:
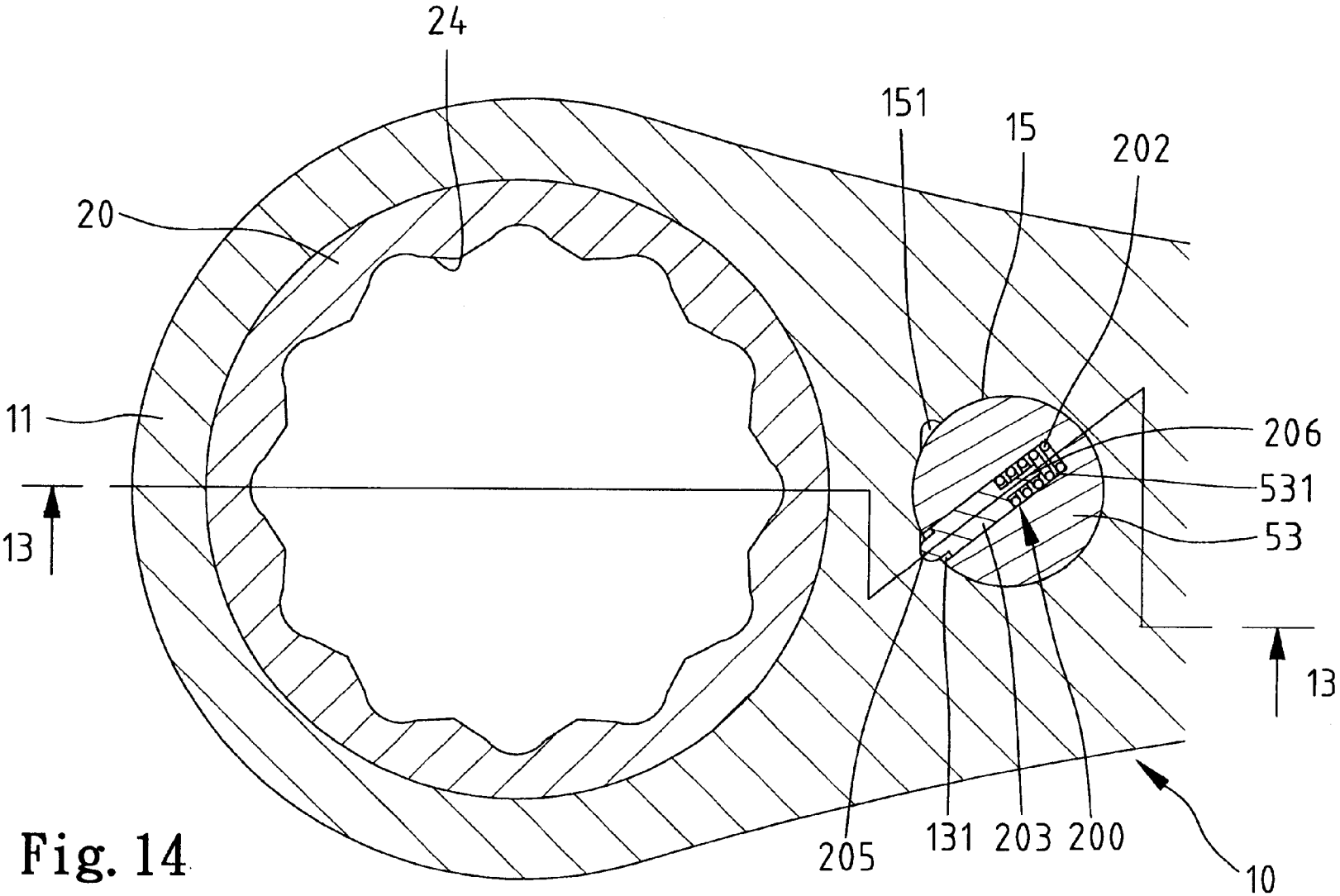
FIG. 14 is a sectional view taken along line 14—14 in FIG. 13.
Figure 15:
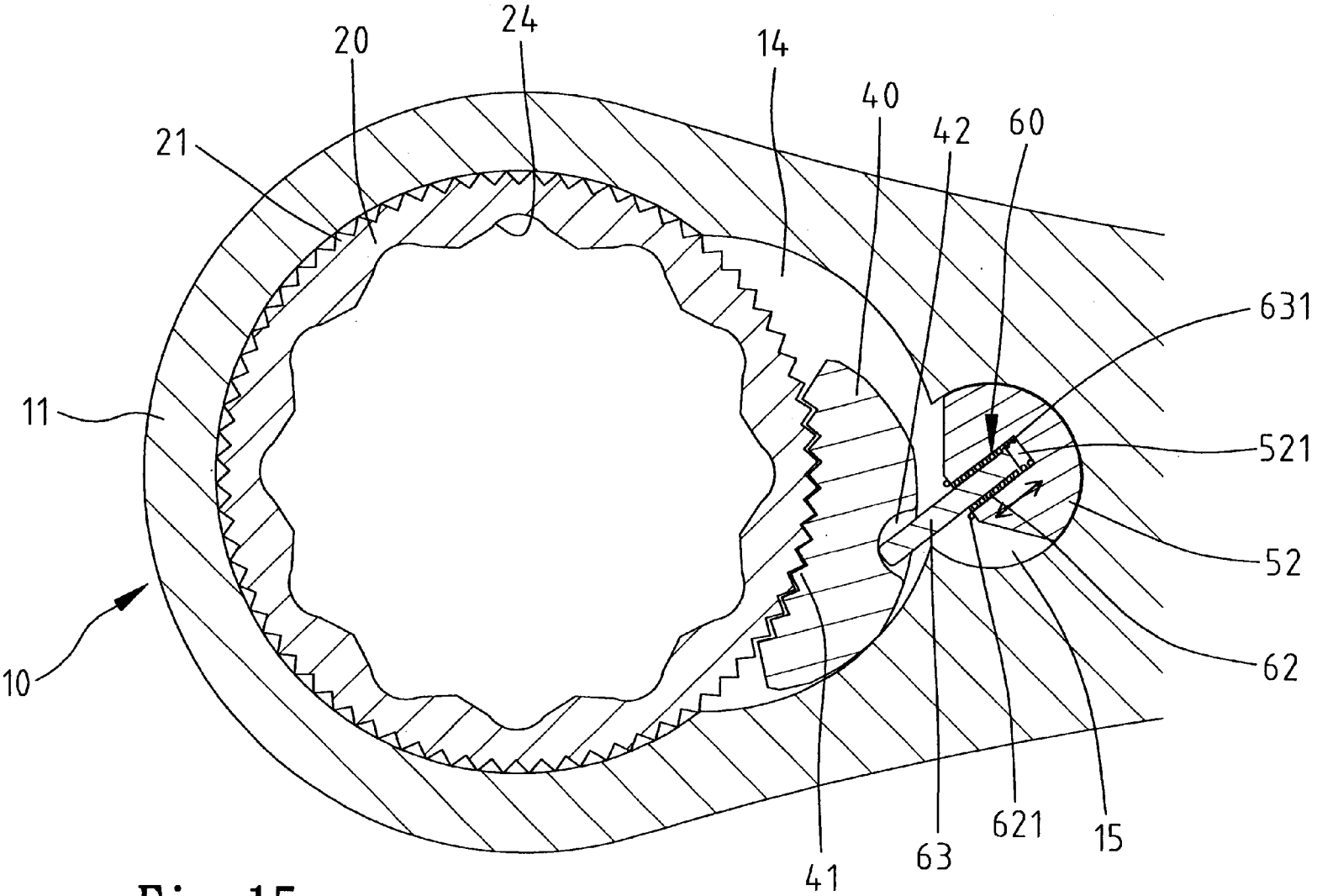
FIG. 15 is a sectional view taken along line 15—15 in FIG. 13.

FIGS. 9 through 11 illustrate a third embodiment in accordance with the present invention that is modified from the first embodiment, wherein the positioning means comprises a pin 204 and an elastic element 202; namely, the ball 201 in the first embodiment is replaced by the pin 204 having a ball-like protrusion for providing a more rigid structure.

FIGS. 12 through 15 illustrates a fourth embodiment in accordance with the present invention that is modified from the second embodiment, wherein the positioning grooves 151 and 152 in the compartment 15 face away from the hole 13 of the head 11. In addition, the positioning means 200 comprises a pin 204 and an elastic element 202. The pin 204 comprises a first end 206 received in a receptacle 531 in the actuating portion 52 of the switch member 50 and a second end 205 selectively engaged with one of the positioning grooves 151 and 152. The first end 206 and the second end 205 of the pin 204 have a reduced diameter, wherein a shoulder is formed on the first end 206. The elastic element 202 is received in the receptacle 531 of the switch member 50 and partially mounted around the first end 206 of the pin 204. The elastic element 202 has a first end attached to the shoulder of the first end 206 of the pin 204. A second end of the elastic element 202 is attached to an end wall defining the receptacle 531 of the switch member 50, best shown in FIG. 13.

According to the above description, it is appreciated that assembly of the wrench in accordance with the present invention can be easily and quickly accomplished by a C-clip. No additional tool is required. In addition, the manufacturing cost of the wrench in accordance with the present invention is inexpensive, as processing of the positioning grooves 151 and 152 can be easily and quickly accomplished by conventional milling machines without the need of expensive computer numeric control (CNC). Alternatively, the positioning grooves 151 and 152 can be formed by means of pressing and then finishing the burrs, which can also be accomplished easily and quickly.

Although the invention has been explained in relation to its preferred embodiment, it is to be understood that many other possible modifications and variations can be made without departing from the spirit and scope of the invention as hereinafter claimed.

What is claimed is:

1. A reversible ratchet type wrench comprising:

a handle comprising a first side and a second side opposite to the first side, the handle comprising a compartment extending from the first side of the handle toward the second side of the handle, an inner periphery defining the compartment comprising a first positioning groove and a second positioning groove extending from the first side of the handle toward the second side of the handle;

a head extending from the handle and including a hole, the handle further comprising a cavity having a first end communicated with the compartment of the handle and a second end communicated with the hole of the head;

a drive member rotatably mounted in the hole of the head, the drive member including a plurality of teeth formed on an outer periphery thereof;

a pawl slidably mounted in the cavity of the handle and comprising a toothed first side facing the drive member and a second side facing away from the drive member;

a switch member rotatably mounted in the compartment, means for cooperating with the first positioning groove and the second positioning groove for retaining the switch member in one of two positions corresponding to two opposite ratcheting directions of the wrench; and means for cooperating with the pawl in response to said one of the positions of the switch member to thereby bias the toothed first side of the pawl to be selectively engaged with the teeth of the drive member.

2. The reversible ratchet type wrench as claimed in claim 1, wherein the cavity and the compartment of the handle define a bridge formed on the first side of the handle for connection with the head.

3. The reversible ratchet type wrench as claimed in claim 1, wherein the outer periphery of the drive member comprises an annular groove in an end of the outer periphery thereof, an inner periphery defining the hole of the head comprising an annular groove in an end thereof, further comprising a C-clip received in the annular groove of the head and the annular groove of the drive member.

4. The reversible ratchet type wrench as claimed in claim 1, wherein the switch member comprises a receptacle, the means for cooperating with the first positioning groove and the second positioning groove comprising a ball and an elastic element received in the receptacle of the switch member for biasing the ball to be selectively engaged with one of the first positioning groove and the second positioning groove.

5. The reversible ratchet type wrench as claimed in claim 1, wherein the switch member comprises a first receptacle, the second side of the pawl comprising a groove having a first end and a second end, the means for cooperating with the pawl comprising an elastic element and a pin, the pin comprising a first end slidably received in the groove of the pawl and a second end having a second receptacle, the elastic element having a first end attached to an end wall defining the first receptacle and a second end attached to an end wall defining the second receptacle for biasing the first end of the pin to be selectively retained in one of the first end and the second end of the pawl.

6. The reversible ratchet type wrench as claimed in claim 4, wherein the switch member comprises a second receptacle, the second side of the pawl comprising a groove having a first end and a second end, the means for cooperating with the pawl comprising a second elastic element and a pin, the pin comprising a first end slidably received in the groove of the pawl and a second end having a third receptacle, the second elastic element having a first end attached to an end wall defining the second receptacle and a second end attached to an end wall defining the third receptacle for biasing the first end of the pin to be selectively retained in one of the first end and the second end of the pawl.

7. The reversible ratchet type wrench as claimed in claim 1, wherein the switch member comprises a receptacle, the means for cooperating with the first positioning groove and the second positioning groove comprising a pin and an elastic element received in the receptacle of the switch member for biasing the pin to be selectively engaged with one of the first positioning groove and the second positioning groove.

8. The reversible ratchet type wrench as claimed in claim 1, wherein the switch member comprises a receptacle, with the means for cooperating with the first positioning groove and the second positioning groove comprising a pin and an elastic element, with the pin comprising a first reduced end and a second end, the first reduced end of the pin having a shoulder, with the elastic element being received in the receptacle of the switch member and partially mounted around the first reduced end of the pin, with the elastic element comprising a first end attached to the shoulder of the pin and a second end attached to an end wall defining the receptacle of the switch member for biasing the second end of the pin to be selectively engaged with one of the first positioning groove and the second positioning groove.

9. The reversible ratchet type wrench as claimed in claim 1, wherein the switch member comprises a receptacle with an opening, the second side of the pawl comprising a groove having a first end and a second end, the means for cooperating with the pawl comprising an elastic element and a pin, the pin comprising a first end slidably received in the groove of the pawl and a second end received in the receptacle, the elastic element having a first end retained on a wall portion surrounding the opening of the receptacle, the elastic element further having a second end engaged with the second end of the pin, thereby biasing the first end of the pin to be selectively retained in one of the first end and the second end of the pawl.

10. The reversible ratchet type wrench as claimed in claim 8, wherein the switch member comprises a second receptacle with an opening, the second side of the pawl comprising a groove having a first end and a second end, the means for cooperating with the pawl comprising a second elastic element and a second pin, the second pin comprising a first end slidably received in the groove of the pawl and a second end received in the second receptacle, the second elastic element having a first end retained on a wall portion surrounding the opening of the second receptacle, the second elastic element further having a second end engaged with the second end of the second pin, thereby biasing the first end of the second pin to be selectively retained in one of the first end and the second end of the pawl.

11. The reversible ratchet type wrench as claimed in claim 9, wherein the switch member comprises a transverse through-hole having a first section and a second reduced section, the means for cooperating with the first positioning groove and the second positioning groove comprising a second pin and a second elastic element, the second pinbeing flat and received in the second reduced section of the transverse through-hole, the second pin having a first end with a dome and a second end, the second elastic element being received in the first section of the transverse through-hole and having a first end attached to the inner periphery defining the compartment of the head and a second end attached to the second end of the second pin for biasing the dome of the second pin to be selectively engaged with one of the positioning groove and the second positioning groove.

12. The reversible ratchet type wrench as claimed in claim 1, wherein the switch member comprises a transverse through-hole having a first section and a second reduced section, the means for cooperating with the first positioning groove and the second positioning groove comprising a pin and an elastic element, the pin being flat and received in the second reduced section of the transverse through-hole, the pin having a first end with a dome and a second end, the second elastic element being received in the first section of the transverse through-hole and having a first end attached to the inner periphery defining the compartment of the head and a second end attached to the second end of the pin for biasing the dome of the pin to be selectively engaged with one of the positioning groove and the second positioning groove.

13. The reversible ratchet type wrench as claimed in claim 4, wherein the first positioning groove and the second positioning groove face the hole of the head.

14. The reversible ratchet type wrench as claimed in claim 5, wherein the first positioning groove and the second positioning groove face the hole of the head.

15. The reversible ratchet type wrench as claimed in claim 6, wherein the first positioning groove and the second positioning groove face the hole of the head.

16. The reversible ratchet type wrench as claimed in claim 8, wherein the first positioning groove and the second positioning groove face away from the hole of the head.

17. The reversible ratchet type wrench as claimed in claim 11, wherein the first positioning groove and the second positioning groove face the hole of the head.

18. The reversible ratchet type wrench as claimed in claim 1, wherein the drive member is a gear wheel including an inner periphery adapted to drive a fastener.

19. The reversible ratchet type wrench as claimed in claim 1, wherein the switch member includes a turn-piece outside the compartment for manual operation.

20. The reversible ratchet type wrench as claimed in claim 1 with the compartment being spaced from the second side of the handle, and with the first and second positioning grooves being spaced from the second side of the handle.

* * * * *